US009941595B2

(12) United States Patent
Yang et al.

(10) Patent No.: US 9,941,595 B2
(45) Date of Patent: Apr. 10, 2018

(54) PATCH ANTENNA WITH PERIPHERAL PARASITIC MONOPOLE CIRCULAR ARRAYS

(71) Applicant: NovAtel, Inc., Calgary (CA)

(72) Inventors: Ning Yang, Calgary (CA); Jerry Freestone, Calgary (CA)

(73) Assignee: NovAtel Inc., Calgary, Alberta (CA)

( * ) Notice: Subject to any disclaimer, the term of this patent is extended or adjusted under 35 U.S.C. 154(b) by 27 days.

(21) Appl. No.: 14/824,832

(22) Filed: Aug. 12, 2015

(65) Prior Publication Data

US 2017/0047665 A1 Feb. 16, 2017

(51) Int. Cl.
*H01Q 19/00* (2006.01)
*H01Q 9/04* (2006.01)

(52) U.S. Cl.
CPC ..... *H01Q 19/005* (2013.01); *H01Q 9/0428* (2013.01)

(58) Field of Classification Search
CPC ..... H01Q 19/005; H01Q 1/48; H01Q 9/0407
USPC ..... 343/700 MS, 833, 834
See application file for complete search history.

(56) References Cited

U.S. PATENT DOCUMENTS 4,864,320 A * 9/1989 Munson ..... H01Q 19/24 343/829
5,767,807 A * 6/1998 Pritchett ..... H01Q 3/24 342/374
2003/0146872 A1* 8/2003 Kellerman ..... H01Q 9/0414 343/700 MS
2004/0257292 A1* 12/2004 Wang ..... H01Q 3/44 343/833
2005/0110683 A1* 5/2005 Song ..... H01Q 1/246 343/700 MS
2005/0280592 A1 12/2005 Yegin et al.
2008/0111757 A1* 5/2008 Bisiules ..... H01P 5/103 343/799
2010/0090903 A1 4/2010 Byun et al.
2011/0050529 A1* 3/2011 Popugaev ..... H01Q 9/0407 343/833

OTHER PUBLICATIONS

"Notification of Transmittal of the International Search Report and the Written Opinion of the International Searching Authority, or the Declaration," International Filing Date: Jul. 28, 2016, International Application No. PCT/CA2016/050887, Applicant: Novatel Inc., dated Oct. 5, 2016, pp. 1-8.

* cited by examiner

*Primary Examiner* — Dameon E Levi
*Assistant Examiner* — David Lotter
(74) *Attorney, Agent, or Firm* — Cesari and McKenna, LLP

(57) ABSTRACT

A patch antenna with wider bandwidth, better axial ratio over the angle and controlled radiation patterns is provided. A central fixed patch antenna is surrounded with reactively or resistively loaded peripheral monopoles as surface-wave excited parasitic radiators. The surrounding monopoles may be printed on the same substrate as the patch, and may take a spiral (pin-wheel) shape.

8 Claims, 13 Drawing Sheets

| NAME | X | Y |
|---|---|---|
| m1 | 1.1750 | -6.3764 |
| m2 | 1.2250 | -18.3859 |
| m3 | 1.2550 | -8.3344 |
| m4 | 1.5250 | -5.8249 |
| m5 | 1.5750 | -12.6231 |
| m6 | 1.6120 | -5.4890 |

| NAME | THETA | ANG | MAG |
|---|---|---|---|
| m1 | 0.0000 | 0.0000 | 9.4471 |
| m2 | -65.0000 | -66.0000 | -2.7497 |

| NAME | THETA | ANG | MAG |
|---|---|---|---|
| m1 | 0.0000 | 0.0000 | 0.2232 |
| m2 | -60.0000 | -60.0000 | 2.1148 |
| m3 | -65.0000 | -66.0000 | 1.3262 |

| NAME | THETA | ANG | MAG |
|---|---|---|---|
| m1 | 0.0000 | 0.0000 | 3.3293 |
| m2 | -60.0000 | -60.0000 | 1.6718 |
| m3 | -65.0000 | -66.0000 | 0.8576 |

PATCH ANTENNA WITH PERIPHERAL PARASITIC MONOPOLE CIRCULAR ARRAYS

BACKGROUND OF THE INVENTION

Patch antennas are often considered for use in high-performance GNSS multi-band antennas due to their planar configuration and easy integration with circuit boards. Patch antennas have a number of noted disadvantages, including, e.g., narrow bandwidth and high directivity. As patch antennas are based on planar resonators, they typically operate best at one certain frequency. Though several technologies have been used to increase the bandwidth available to patch antennas, it is still difficult to achieve required bandwidth. This is especially true when the substrate material and given physical size is limited. The patch antenna needs a certain size (typically half guided wavelength) to resonate at the operation frequency, therefore the beam-width, and consequently the radiation pattern roll-off, is often fixed using given material and technology.

SUMMARY OF THE INVENTION

The disadvantages of the prior art are overcome by providing a patch antenna with peripheral parasitic monopole circular arrays. The antenna illustratively comprises of three elements. A first element comprises of a patch antenna. The patch antenna may comprise a single layer or a stacked-layer patch antenna. The second element comprises a set of reactive/resistive loaded monopoles that are rotational symmetrically surrounding the patch antenna. The monopoles may be terminated by certain phase-delay lines. The third element comprises a ground plane.

BRIEF DESCRIPTION OF THE DRAWINGS

The above and further advantages are described in reference to the following figures, in which like reference numerals indicate identical or functionally similar elements.

DETAILED DESCRIPTION OF AN ILLUSTRATIVE EMBODIMENT

A patch antenna constructed in accordance with illustrative embodiments of the present invention utilizes a pin-wheel shaped surrounding monopole radiators to excite the surface wave excited by the patches. Such an antenna has several advantages over the prior art. First, an antenna made in accordance with principles of the present disclosure has a much improved bandwidth due to the coupling of the multiple surround monopole radiators. Second, a patch antenna in accordance with the principles of the present disclosure provides a reduced cross-polarization due to the surface wave current manipulation. Further, the circular polarization is improved by using multiple feeds and sequential rotationally excited spiral pin-wheel shaped surrounding radiators. Third, an antenna in accordance with the present disclosure provides beam shaping capability in that the position, shape and refractive coefficients of the surrounding radiators may be varied to change the radiation pattern.

Figure 1:
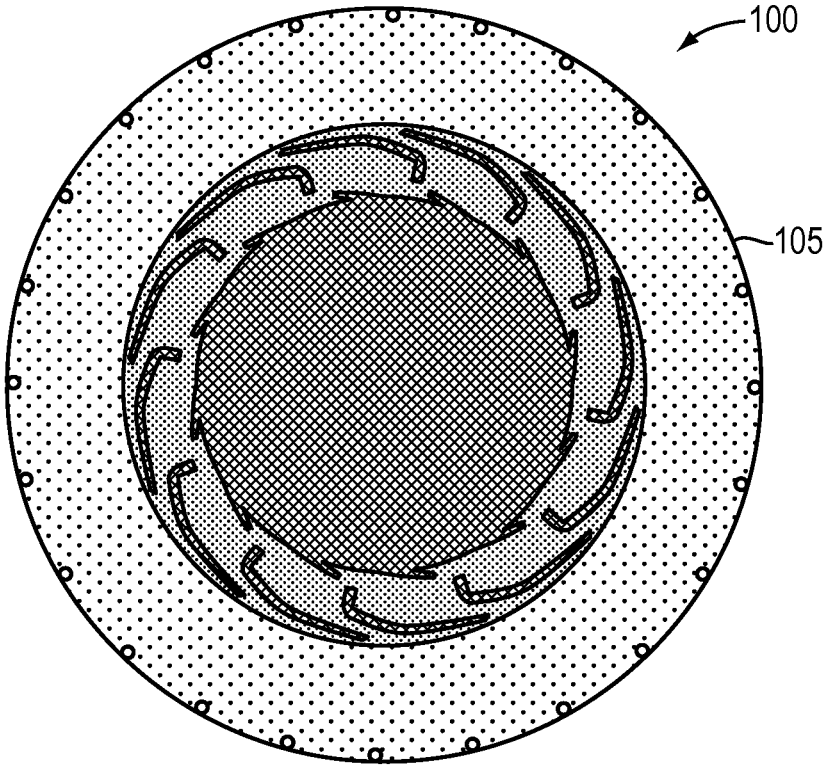
FIG. 1 is a perspective view of an exemplary antenna in accordance with an illustrative embodiment of the present invention.
Figure 2A:
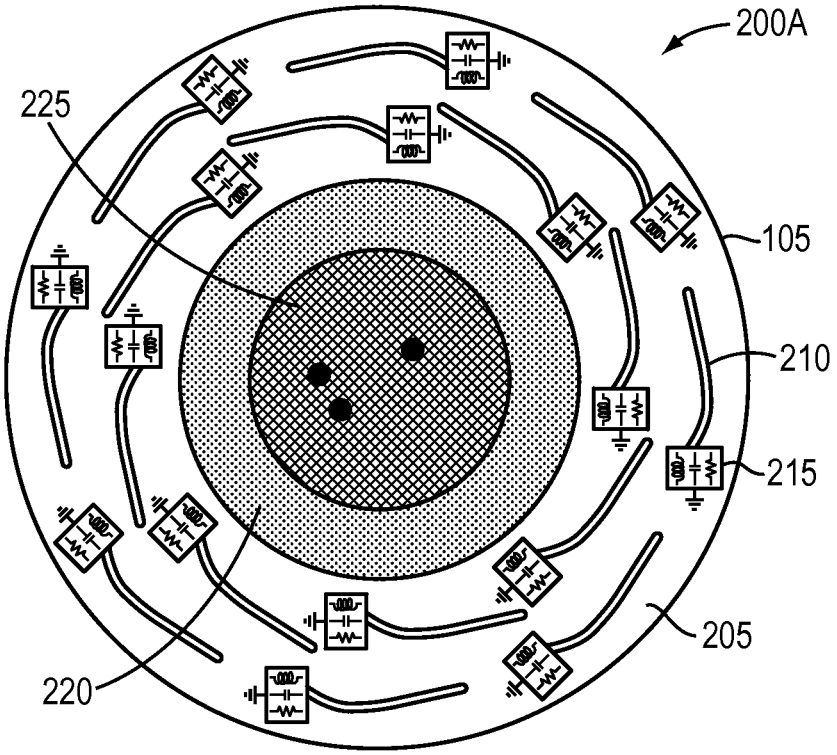
FIG. 2A is a top perspective view of an exemplary antenna in accordance with an illustrative embodiment of the present invention.

FIG. 1 is a perspective view 100 of an exemplary antenna 105 in accordance with an illustrative embodiment of the present invention. View 100 shows in overview, the various elements of the patch antenna in accordance with an illustrative embodiment. FIG. 2A is a top perspective view 200A of the antenna 105 illustrating the various elements in more details in accordance with an illustrative embodiment of the present invention. The antenna 105 illustratively comprises a ground plane 205 over which one or more patch antennas 220 are overlaid. One or more feed points 225 are operatively connected to the patch antennas 220. A plurality of monopoles 210 are arranged around the patch antennas 220. In certain illustrative embodiments, the monopoles may be terminated with phase delay lines 215.

Figure 2B:
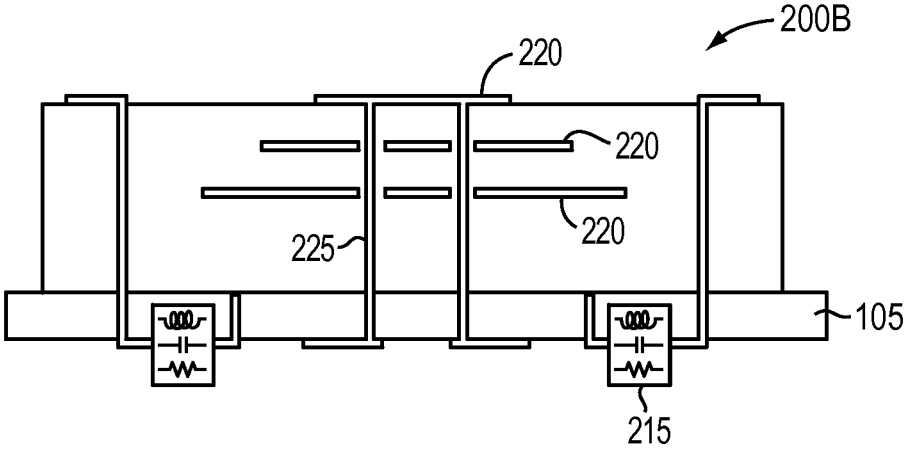
FIG. 2B is a side perspective view of an exemplary antenna in accordance with an illustrative embodiment of the present invention.

FIG. 2B is a side perspective view 200B of an exemplary antenna in accordance with an illustrative embodiment of the present invention. As can be seen, the one or more patch antennas 220 may be arranged in a stacked configuration. Three patch antennas are shown; however, it should be noted that in alternative embodiments, any number may be utilized. Thus, the description and illustration of three antennas 220 should be taken as exemplary only.

Figure 3:
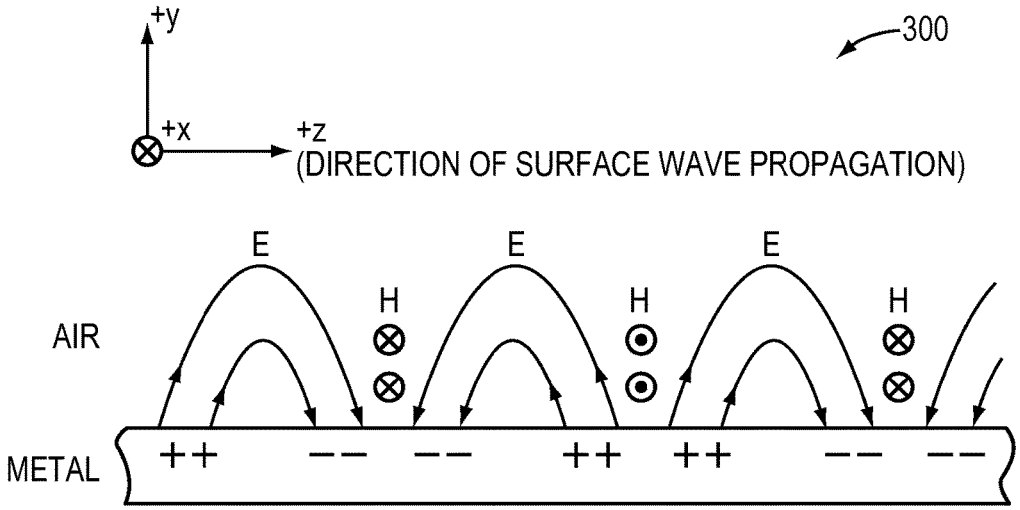
FIG. 3 is a view of propagation of a TM surface wave along a metal/air surface in accordance with an illustrative embodiment of the present invention.

A patch antenna equivalently radiates at the resonant slot ring formed between the metallic patch and the ground plane. Since the dielectric substrate for antennas typically has a truncated edge, it does not support the propagation of dielectric/metal interface bounded surface waves. However, the fringe field in the patch edge does launch TM surface waves propagating along the air-metal (ground plane) surface. FIG. 3 is an illustration 300 of the propagation of TM surface waves along the metal/air surface. Such a surface wave is also called surface plasmons in optics, and at microwave frequency it extends a great distance into the surrounding space with very low decaying factor. The H-fields of such a wave are transverse to the direction of the propagation, wherein corresponding longitudinal surface current flows on the metal conductor; while the E-fields are linked to oscillating (at the frequency of the radiating waves) charges distributed on top of the metal and therefore forming loops vertically jumping in and out of the surface along the longitude direction. It propagates at nearly the freespace speed of the light. It is therefore often described as surface currents, rather than surface waves in microwave and in fact they are not so different than the normal alternating currents on any conductor.

The surface wave travels from the formed patch-slot ring all the way to the edge of the truncated ground plane, then would be diffracted, where it re-radiates to the space as if the metal edge were point sources. These radiations contribute to the far-field of the antenna in all direction, the upper-hemisphere, lower-hemisphere and the horizon. For GNSS applications, these unexpected radiations generally increase the reception of noise signal from multipath or nearby interferences. Several technologies have been used to suppress or attenuate the TM surface current from propagating, such as chock ring and resistive stealth ground plane. The surface impedance for the wave on a flat metal sheet is derived as $$Z_s = \frac{E_z}{H_x} = \frac{1+j}{\sigma\delta}[\Omega/\square]. \tag{1}$$

where σ is the metal conductivity, δ is the skin depth. From this equation, a conductor surface typically shows low surface impedance.

Figure 4:
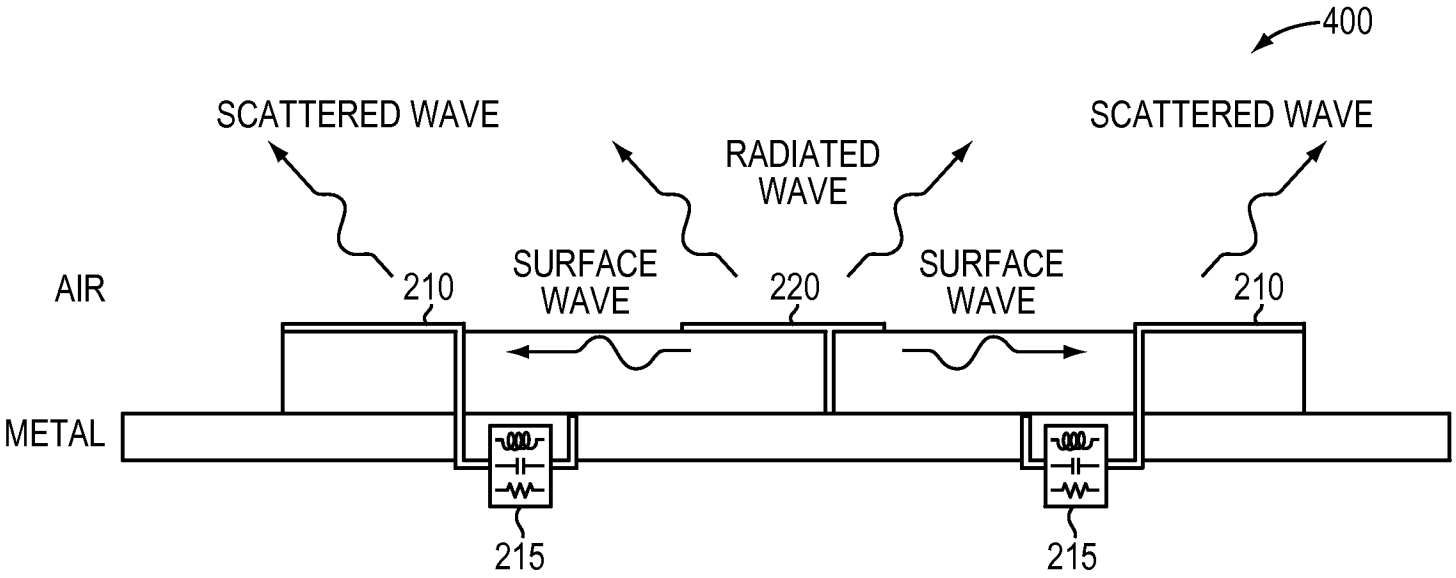
FIG. 4 is a view illustrating the interaction of a patch antenna excited surface wave with the antenna in accordance with an illustrative embodiment of the present invention.

FIG. 4 is an illustration 400 of the interactions of the patch antenna excited surface wave with the antenna in accordance with an illustrative embodiment of the present invention. Illustratively, surface wave is generated by the patch antenna and then it travels and hits on the surrounding monopole elements before it reaches the edge of the ground. Depending on the loading impedance of the RLC tank ($Z_L$=R//L//C=$R_L$+j$X_L$, it is a combination of R, L and C, which can be designed to control its matching to the input impedance of the monopole at the port), some part of the surface wave signals induced in the parasitic monopoles are first guided through the phase-delay lines and then are reflected (scattered) and re-radiated. The reflection coefficient at the monopole is $$\Gamma = \frac{Z_L - Z_0}{Z_L + Z_0} = \frac{(R_L^2 + X_L^2 - Z_0^2) + j2X_LZ_0}{(R_L + Z_0)^2 - X_L^2}, \tag{2}$$

where $Z_0$ is the characteristic impedance of the delay line. If the load is resistive (with R only in the loading tank, $X_L$=0), some part of the surface wave power is attenuated:

$$\Gamma = \frac{R_L - Z_0}{R_L + Z_0}. \tag{3}$$

In the case of a short-circuited ($Z_L$=0), total reflection happens at the monopole port and the monopole "captured" power is completely re-radiated:

$$\Gamma = \frac{-Z_0}{Z_0} = -1. \tag{4}$$

If the load is lossless ($R_L$=0) and reactive, the reflection coefficient reads:

$$\Gamma = \frac{(X_L^2 - Z_0^2) + j2X_LZ_0}{Z_0^2 - X_L^2} = -1 + j\frac{2\tilde{x}_L}{1-\tilde{x}_L^2}, \tag{5}$$

where $$\tilde{x}_L = \frac{X_L}{Z_0}$$

is the normalized reactance of the terminating load to $Z_0$. From this equation we know that the phase of the reflected signal is controllable by varying the reactance value and length of the delay line:

$$\phi_\Gamma = \tan^{-1}\frac{2\tilde{x}_L}{\tilde{x}_L^2 - 1}. \tag{6}$$

The equation (6) reveals two points. First, the phase of the re-radiated signal from each monopole can be varied by tuning the reactance load. Second, when the load reactance is small, the phase has more significant change compared to very large reactance.

The magnitude of the re-radiated power will also depend on structure of the monopoles, for instance, the height and shape of the monopole defines how much power is induced and also the radiation efficiency. Typically, the parasitic elements are near to resonance to re-radiate the surface wave more efficiently, i.e., when the total length of the monopole is close to multiple-quarter of guided wavelength, the system reaches highest efficiency.

Assuming the excitation current of center patch is $I_0$ and the corresponding radiated far field is $\vec{E}_0$ and the peripheral N monopoles are equally spaced along a ring, from circular antenna array theory the total radiated electric field is written as the superposition of the contributed fields from all the radiators $$\vec{E}_{Total}(r,\theta,\phi) = \vec{E}_0(r,\theta,\phi) = \vec{E}_{Monopole}\sum_{n=1}^{N}\Gamma_n I_0 e^{-jk_s d}e^{jkd\sin\theta\cos(\phi-\frac{2\pi n}{N})}, \tag{7}$$

where k is the freespace wavenumber, $k_s$ is the surface-wave wavenumber ($k_s \approx k$), d is the distance from center patch to the surrounding monopole ring (the radius of the ring), $\Gamma_n$ is the reflection coefficient at parasitic monopole n, and $\vec{E}_{Dipole}$ represents the field radiated by a single monopole element [1]. By varying the distance between the patch to the surrounding monopoles and the reflection coefficient (magnitude and phase), certain type of radiation pattern could be synthesized. Based on this principle, single-fed reactively beam- or null-steered antennas are possible.

This concept maybe explained in analogy to reflect-array where an array of reactively-terminated antenna elements is placed at the reflector position facing a source exciter to achieve very high-gain or steerable beam antenna array. In current proposal, the source is the surface wave generated by the antenna, and the reflector array is located in the same plane as the source. In another way, this monopole structure can also be explained as high-impedance surface (the impedance is much higher than the surface wave impedance) that scatters the surface wave to the space.

Due to this process, the surrounding parasitic monopoles act as the loads to the main patch antenna which reduces the quality (Q) factor of the patch resonators. This results in a substantial increase in the bandwidth of the antenna. Further, this process causes the near field and far field of the antenna to be changes, therefore the radiation pattern of the antenna can be varied. An example of this varying is that the roll-off may be decreased or increased. As will be appreciated by those skilled in the art, this is sometimes desirable for GNSS applications. Additionally, the axial ratio at the low-elevation angle may be improved since the unwanted diffraction at the ground edge is manipulated by the purposely added parasitic radiators.

Figure 5A:
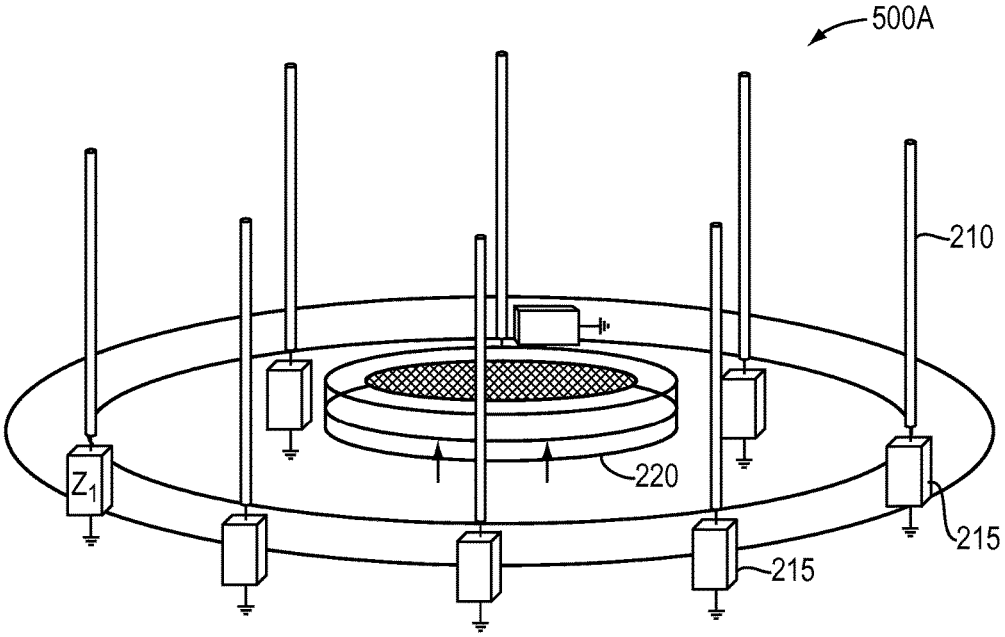
FIG. 5A is a perspective view of a patch antenna surrounded by vertical wire monopoles in accordance with an illustrative embodiment of the present invention.
Figure 5B:
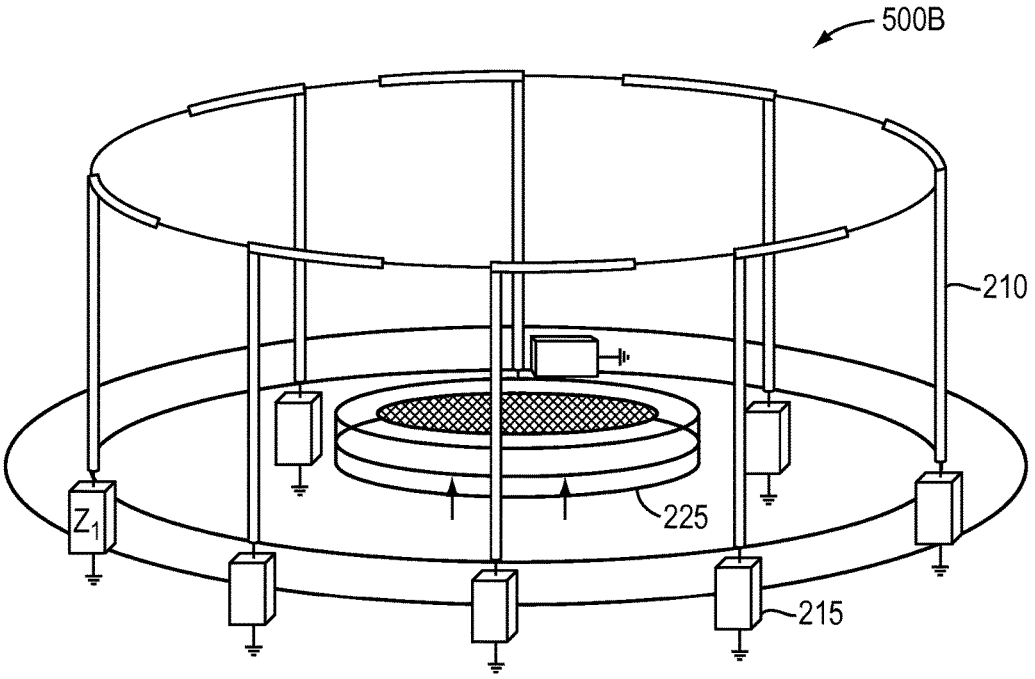
FIG. 5B is a perspective view of a patch antenna surrounded by inverted L monopoles in accordance with an illustrative embodiment of the present invention.
Figure 5C:
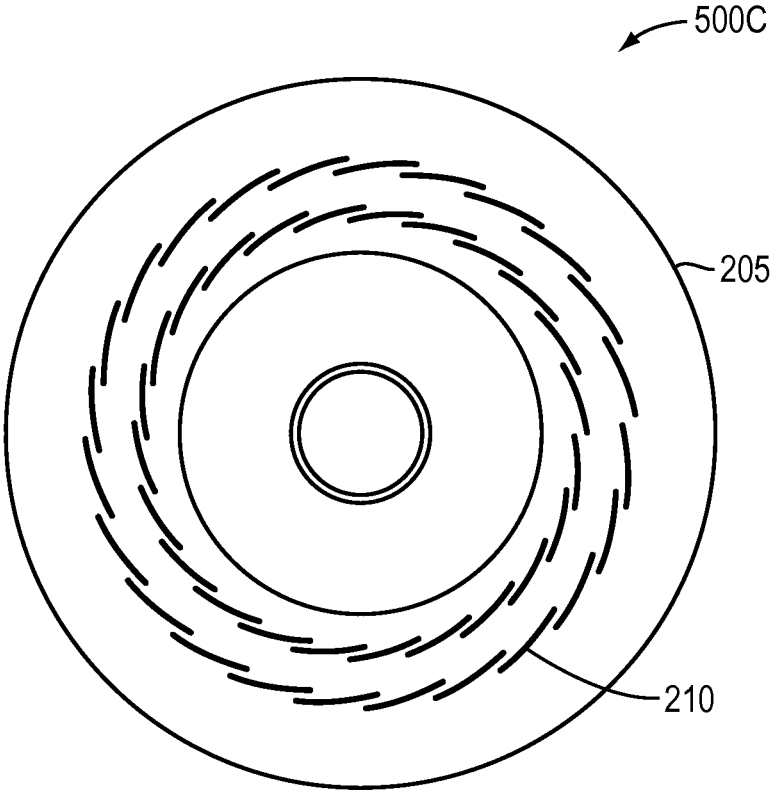
FIG. 5C is a perspective view of a patch antenna surrounded by printed strip inverted L spiral monopoles in accordance with an illustrative embodiment for the present invention.
Figure 5D:
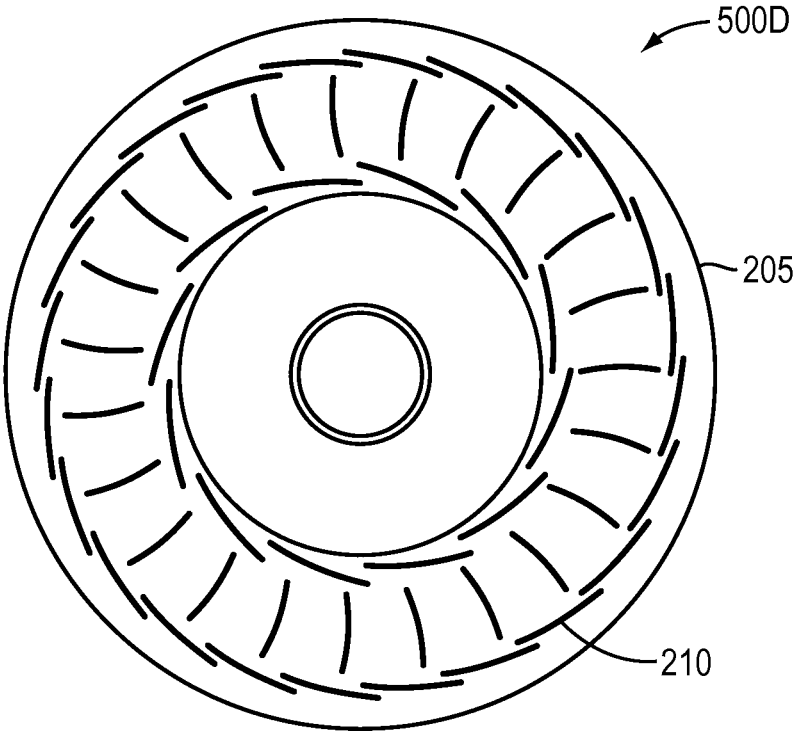
FIG. 5D is a perspective view of a patch antenna surrounded by a multi-array of inverted L spiral monopoles in accordance with an illustrative embodiment of the present invention.

FIGS. 5A-5D illustrate various alternative embodiments of the present invention. Exemplary view 500A (FIG. 5A) is of a patch antenna 220 surrounded by vertical wire monopoles 210. The monopoles may, in alternative embodiments, be connected to phase delay lines 215. View 500B (FIG. 5B) is of an alternative embodiment where the monopoles 210 are in the shape of inverted L's. FIG. 5C is a top perspective of an alternative embodiment where the patch antenna is surrounded by printed strip inverted L spiral monopoles. FIG. 5D is a tope perspective view 500D of the patch antenna surrounded by a multi-array of inverted L monopoles. As will be appreciated by FIGS. 5A-5D, a wide variety of arrangements of the monopoles may be utilized in accordance with alternative embodiments of the present invention. Thus, the present invention should not be viewed as limited to those specific examples described herein.

Depending on the required radiation performance, the surrounding monopoles may take the shape of vertical wires, inverted-L (or inverted-F), and printed inverted-L spirals (which forms a pin-wheel shape). Besides this, one, two or more surrounding arrays of monopoles with different lengths may be combined to provide more flexibility for forming the beam according to the total radiation given in Eq. 7: more arrays may provide more frequencies of operation; different clock-wise orientation of the spirals may give control of different polarization; and the interactions among the neighboring arrays may show more exotic electromagnetic band-gap effect which is useful for multipath rejections.

The present invention utilizes a patch antenna system with increased bandwidth, improved radiation pattern and reduced rolling-off for GNSS application. By varying loading circuit, the radiation pattern may be controlled. The antenna only needs to be fed at the center patch antenna element with multiple quadrature feeds. The design has a number of advantages, including, e.g., increased bandwidth, reduced cross polarization, varied radiation patterns and low cost.

Figure 6:
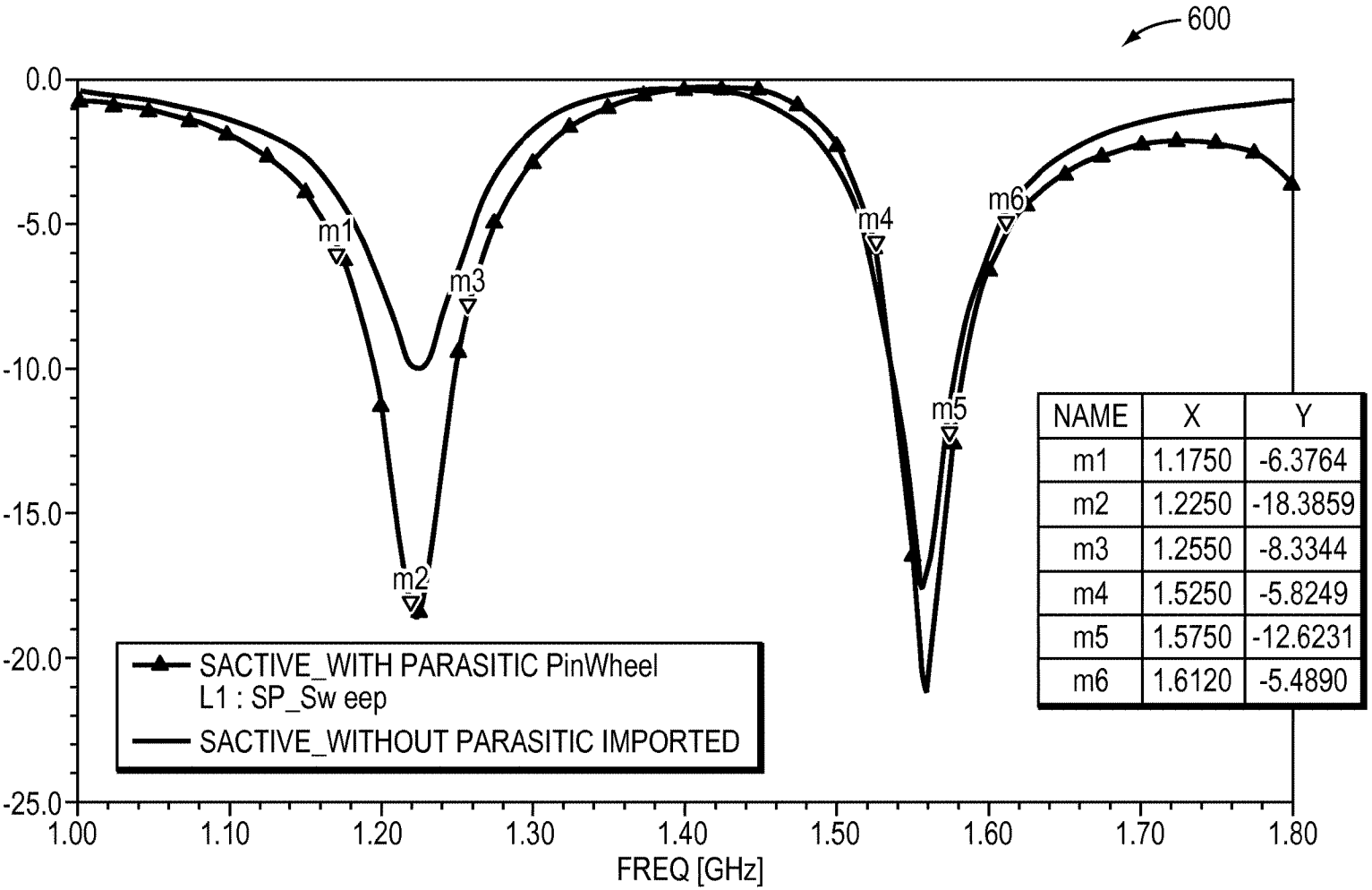
FIG. 6 is a graph illustrating the active return loss of an antenna in accordance with an illustrative embodiment of the present invention.

FIG. 6 is a chart 600 that compares the active return loss of a quad-fed stacked GNSS patch antennas with and without a single-array of pin-wheel spiral shaped parasitic peripheral monopoles in accordance with embodiments of the present invention. Chart 600 shows that the impedance bandwidth of the antenna is improved significantly, which is favored in most situations. It should be noted that utilizing a single array of pin-wheel spiral shaped parasitic peripheral monopoles should be taken as an exemplary embodiment only.

Figure 7:
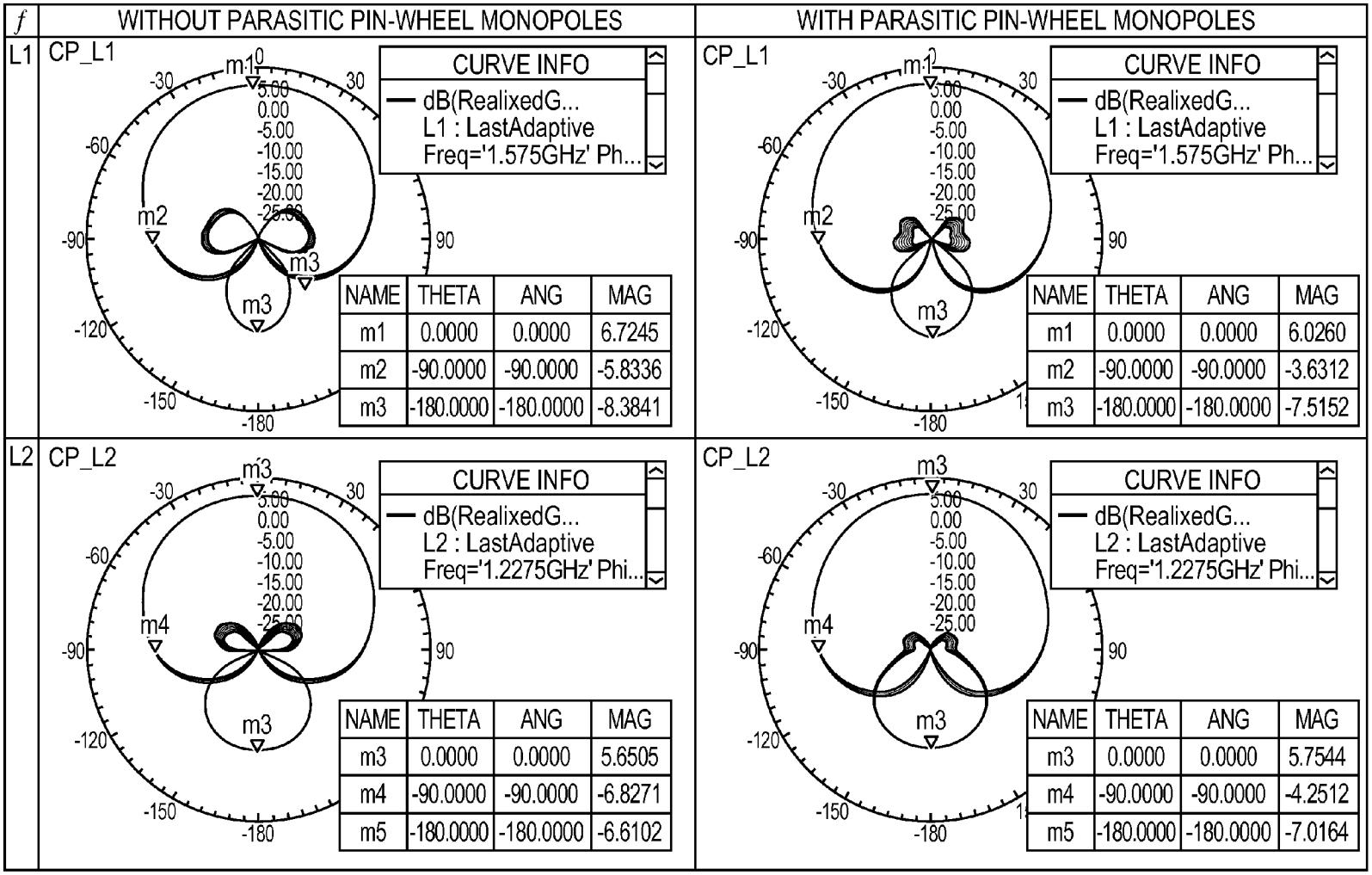
FIG. 7 is a set of graphs illustrating radiation patterns in accordance with an illustrative embodiment of the present invention.

FIG. 7 is a chart 700 that compares the polar radiation patterns for one of the new antenna with the one without the parasitic pin-wheel monopoles. The axial ratio is decreased by using the proposed structure and the low-elevation angle multi-path could be improved too. Additional study has shown that using resistive loading, or adding some specially designed monopole patterns, the front-to-back ratio is significantly increased.

It is demonstrated from above realized-gain radiation pattern comparisons, the horizon ($\theta=90°$) right-handed circular polarization gain is improved by 2.2 dB for L1 (1575.4 MHz) frequency, and 2.6 dB for L2 (1227.6 MHz) frequency.

Figure 8A:
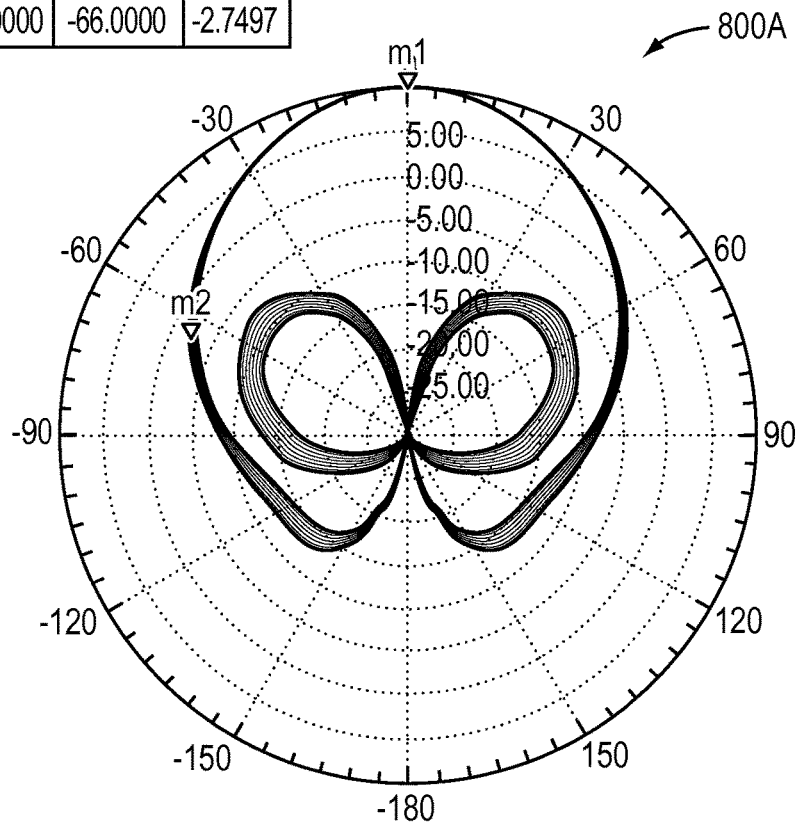
FIG. 8A is a view of an alternative radiation pattern in accordance with an illustrative embodiment of the present invention.
Figure 8B:
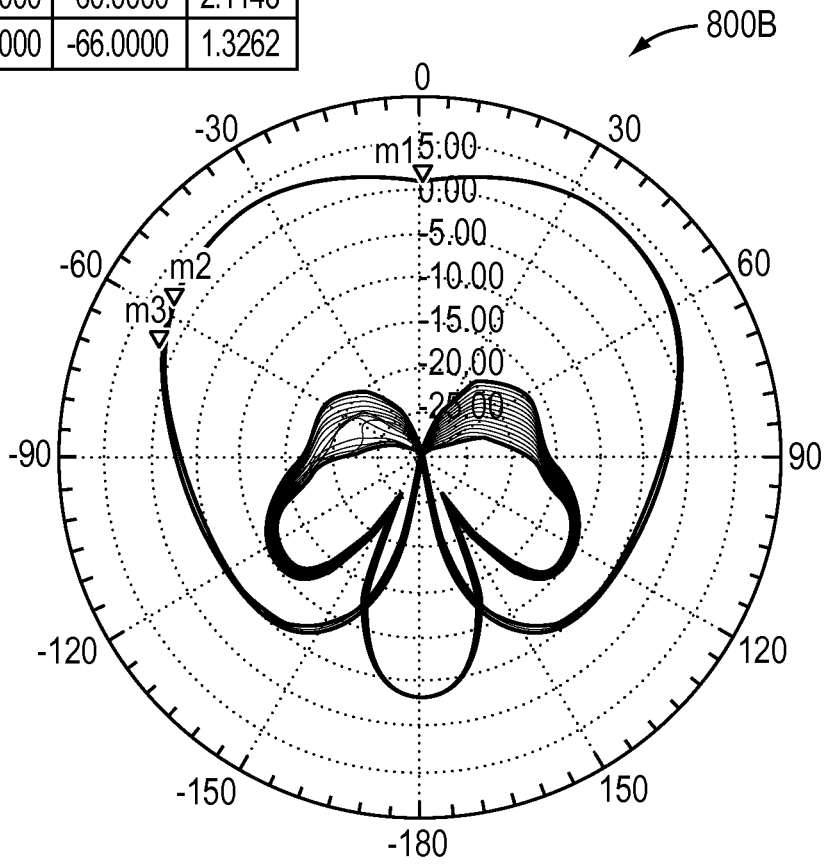
FIG. 8B is a view of an alternative radiation pattern in accordance with an illustrative embodiment of the present invention.
Figure 8C:
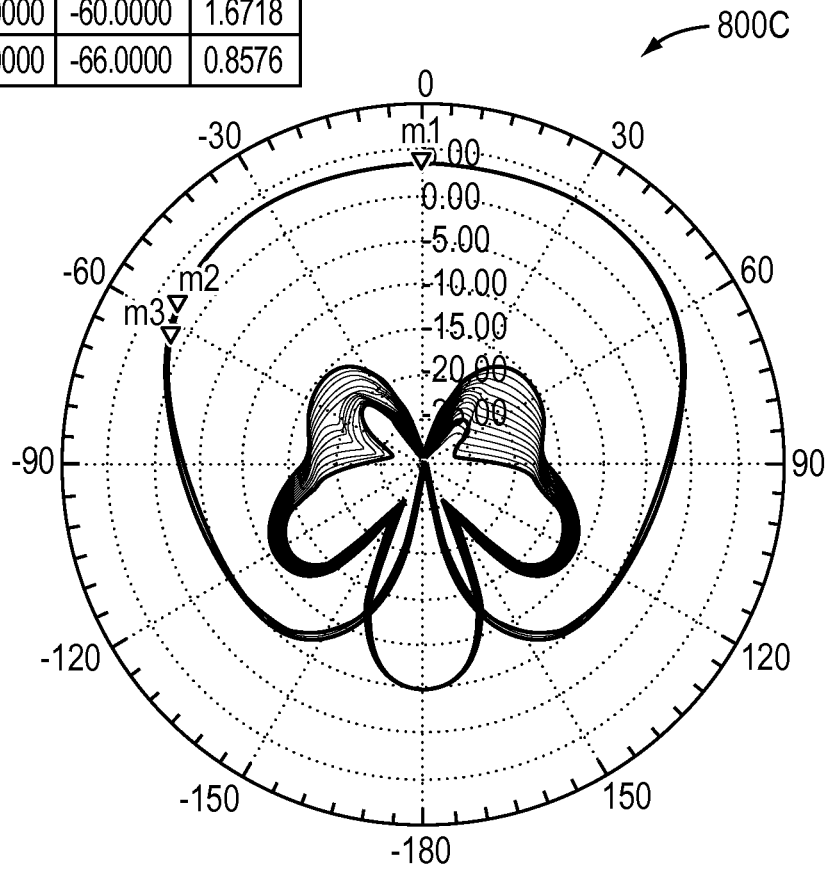
FIG. 8C is a view of an alternative radiation pattern in accordance with an illustrative embodiment of the present invention.

It should be noted that the results described herein are demonstrated as an example only, and the radiation patterns can be manipulated by certain design according to system requirements, especially by using multi-array of parasitic elements and/or using different loading circuits. For example, FIG. 8A shows an achieved RHCP radiation pattern with higher directivity (9.4 dBic gain at zenith, and quickly roll down by 17.4 dB to −8 dBic at horizon) and low back-side cross-polarization radiation. FIG. 8B is an another example that illustrates that the RHCP radiation shows a near conical pattern, 0.2 dBic low at zenith while as high as −0.5 dBic at horizon, which is ideal for low-elevation coverage. A third example is shown in FIG. 8C in which the RHCP radiation pattern is almost omnidirectional in the upper-hemisphere, for which the gain roll-off from zenith to horizon is only about 5 dB.

The parasitic antenna elements may be printed as simple traces at the same layer as one or several of the patches. It is easily to be integrated with the passive or active loading circuit with tuning or switching capability.

While various embodiments have been described herein, it should be noted that the principles of the present invention may be utilized with numerous variations while keeping with the spirit and scope of the disclosure. Thus, the examples should not be viewed as limited but should be taken as way of example.

What is claimed is:

1. A system comprising: a ground plane; one or more patch antennas located above the ground plane; and a plurality of monopoles surrounding the one of more patch antennas shaped as inverted-L's having a vertical leg and a horizontal leg, wherein the horizontal legs of the inverted L's follow a substantially circular arrangement centered on the one or more patch antennas and wherein each of the horizontal legs partially overlaps at least one of the other horizontal legs in a plane that is parallel to the ground plane.

2. The system of claim 1 wherein the one or more patch antennas comprises a single layer patch antenna.

3. The system of claim 1 wherein the one or more patch antennas comprises the one or more patch antennas arranged in a stacked layer.

4. The system of claim 1 further comprising one or more phase delay lines operatively connected to the one or more monopoles.

5. The system of claim 1 wherein the plurality of monopoles are shaped as vertical wires.

6. The system of claim 1 wherein the plurality of monopoles are shaped as inverted L's.

7. The system of claim 1 wherein the plurality of monopoles are shaped as printed inverted L spirals forming a pinwheel shape.

8. The system of claim 1 wherein the plurality of monopoles are configured as one or more arrays of monopoles having differing lengths.

* * * * *